US005161330A

United States Patent [19]

Auriemma

[11] Patent Number: 5,161,330

[45] Date of Patent: Nov. 10, 1992

[54] SIDE ADJUSTABLE DOOR ROLLER ASSEMBLY

[75] Inventor: Nicholas A. Auriemma, Miramar, Fla.

[73] Assignee: DNS Industries, Miami, Fla.

[21] Appl. No.: 712,137

[22] Filed: Jun. 3, 1991

[51] Int. Cl.[5] ..... E05D 13/02

[52] U.S. Cl. ..... 49/420; 16/105; 49/421; 49/425

[58] Field of Search ..... 49/425, 427, 420, 421; 160/89-91, 371, 381; 16/105, 91

[56] References Cited

U.S. PATENT DOCUMENTS

| | | | |
|---|---|---|---|
| 3,237,238 | 3/1966 | Anderson | 49/425 X |
| 3,284,953 | 11/1966 | Rifkin | 49/420 |
| 3,731,431 | 5/1973 | Banner | 49/420 |
| 4,064,593 | 12/1977 | Helmick | 16/105 |
| 4,189,870 | 2/1980 | Helmick | 49/421 X |

*Primary Examiner*—Philip C. Kannan

*Attorney, Agent, or Firm*—D. Peter Hochberg; Mark Kusner; Louis J. Weisz

[57] ABSTRACT

A side adjustable roller assembly for a sliding door comprises a housing containing a rotatable cam and a wheel carriage with a guide wheel mounted therein pivotally attached to the housing. The assembly is insertable into a recess in the edge of a door, being held therein by a slot in one end of the housing, and by a bend in a strip of spring steel attached to the housing at the other end which engage opposite ends of the recess, respectively. Contact of the cam surface with that of the wheel carriage controls the distance that the carriage can be pivoted into the recess by the door's weight, against the force of an associated spring urging the carriage away from the recess. The point of engagement of the cam surface with the carriage, and therefore the distance between the door's edge and the surface over which it is mounted, depends upon the degree of the cam's rotation, determined by adjustment of cam mounting trunions which can be accessed from the side of the housing.

15 Claims, 2 Drawing Sheets

SIDE ADJUSTABLE DOOR ROLLER ASSEMBLY

TECHNICAL FIELD

This invention relates to roller assemblies for use in sliding doors and panels. More particularly, this invention relates to adjustable roller assemblies for sliding doors and panels that allows the vertical height of the doors, and panels to be adjusted to assure proper operation. Specifically, this invention relates to a door or panel roller assembly provided with adjusting means accessible from the side of the assembly, and through the door or panel in which the assembly is mounted, such access facilitating vertical adjustment thereof.

BACKGROUND OF THE INVENTION

Sliding doors of a type suitable for patio and porch enclosures are well known and widely used in present-day construction. Their frames are generally fabricated from metal profiles and provided with either glass or screen, depending upon the use to which the doors are to be put. The doors are mounted on grooved wheels or rollers adapted to roll on a guide track or rail which directs the doors during their movement, rollers being located at both the top and the bottom of the doors in some instances. The doors described are usually fabricated from lightweight materials, such as aluminum, so that they will be easy to roll back and forth during the opening and closing process. In this regard, screen doors of the type described are usually relatively light, commonly weighing less than about ten pounds.

While the lightness of the doors and panels greatly facilitates their ease of use, unfortunately, their lack of weight provides certain inherent disadvantages. One of these is the tendency of the door rollers to become disengaged from their track. This tendency to derail is caused by a variety of factors including, for example, variations in clearance between the track and the door, resulting from clearance faults between the door and the opening in which it is located; from the tendency of individuals to lift up on the doors when operating them, as well as for various other reasons. Irrespective of the cause for derailment, whenever the doors are disengaged from their tracks, they immediately become inoperable and must be reinstalled, frequently a difficult task.

In the past, a number of solutions have been proposed to solve the problem described, particularly including the use of spring-loaded rollers which force the rollers into firm engagement with their tracks. Oftentimes, however, the spring-loaded rollers have been undesirably complicated and have proven to be expensive and difficult to make and install in the course of the doors' manufacture. Furthermore, the load-carrying capacity of such roller has frequently been inferior as well.

Still another problem has involved adjustment of the spring, required to provide a proper engaging force between the track and the rollers associated with it. Generally, such force has been suitably increased or decreased by means of adjusting screws forming part of the roller assembly. However, the mechanics of the assemblies have typically required that the adjusting screws be located in positions in which they are not readily accessible, making the adjustment process difficult.

BRIEF DESCRIPTION OF THE INVENTION

In view of the foregoing, therefore, it is a first aspect of this invention to provide an adjustable door roller assembly for sliding doors and panels.

A second aspect of this invention is to provide a door roller assembly for sliding doors and panels that is adjustable from the sides thereof.

Another aspect of this invention is to provide a door roller assembly for sliding doors and panels that is readily installed therein.

A further aspect of this invention is to provide a door roller assembly for sliding doors and panels that is relatively simple and inexpensive to construct.

An additional aspect of this invention is to provide a door roller assembly that includes means for retaining its adjustment once it has been adjusted.

Still another aspect of this invention is to provide a door roller assembly that permits vertical adjustment thereof in increments.

Yet a further aspect of this invention is to provide an adjustable door roller assembly that is durable and has the capability of supporting significant loads.

The preceding and additional aspects of this invention are provided by a side-adjustable door roller assembly comprising a housing and wheel carriage means, one end of the carriage means being pivotally attached to the housing, and the other end having a guide wheel rotatably attached thereto. Additional components include spring means for urging the wheel away from the housing; cam means adjustable from the side of the housing for controlling the distance of the wheel from the housing when the wheel is urged against the force of the spring toward the housing; and means for connecting the assembly to a door.

The preceding and other aspects of the invention are provided by a side-adjustable door roller assembly comprising a housing with parallel, elongated sides, and wheel carriage means a first end of which is attached to the sides thereof at a pivot point with a wheel rotatably attached to a second end thereof, the wheel carriage means being pivotable about the point, parallel to the housing sides. Also included are spring means which urge the first end to pivot about the pivot point, away from the housing; cam means mounted in the housing and adjustable from the sides thereof which limits the distance the first end can pivot toward the housing when the first end is urged to pivot against the urging of the spring means. The cam means is adjustable from at least one side of the housing to fix such distance, and means is provided for connecting the housing to a door.

The preceding and further aspects of the invention are provided by a side-adjustable door roller assembly comprising a housing with parallel, spaced apart, elongated sides having a slot in a first end thereof, and a substantially U-shaped wheel carriage, a first end of which is pivotally attached to the housing and a second end of which has a rotatable guide wheel attached thereto. Also included in the assembly is a spring, bearing against the housing and against the carriage, which urges pivoting of the carriage away from the housing, and a strip of spring metal having one end thereof attached to the housing, while its other end has a notch-shaped bend therein and extends from a second end of the housing. A cam adjustable from the side of the housing and mounted therein is also provided for fixing the distance between the housing and the carriage when a force acts on the door roller to urge the carriage toward the housing, against the urging of the spring. The cam has a friction pad extending from each side thereof adapted to engage the sides of the housing, thereby maintaining the cam setting.

BRIEF DESCRIPTION OF THE DRAWINGS

The invention will be better understood when reference is had to the following FIGS. in which like-numbers refer to like-parts, and in which.

DETAILED DESCRIPTION OF THE INVENTION

Figure 1:
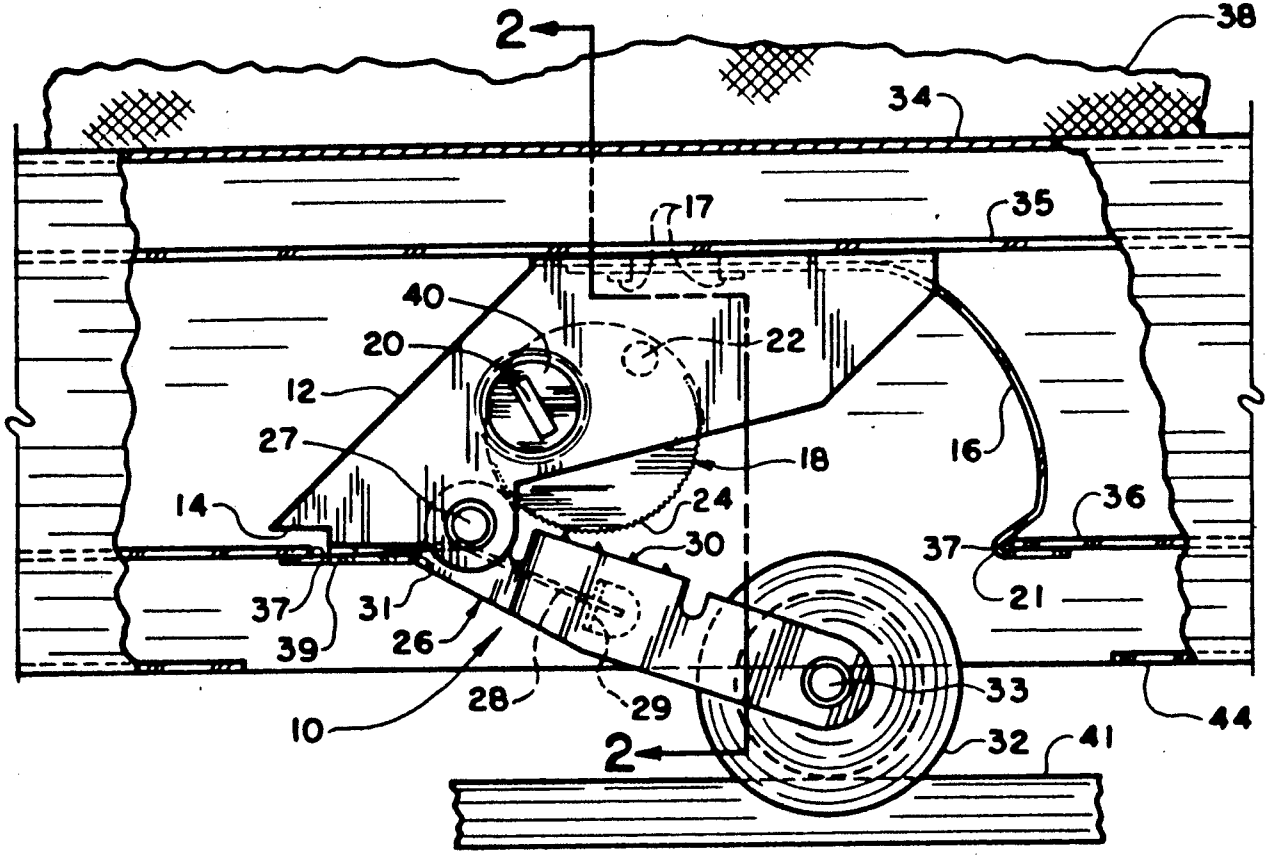
FIG. 1 is a front elevation of a roller assembly of the invention shown mounted in a partial, broken-away portion of a door.

FIG. 1 is a front elevation of a roller assembly shown mounted in a partial, broken-away portion of a door. As shown, the wheel assembly, generally 10, comprises an assembly housing 12 to which a wheel carriage, generally 26, is pivotally attached by means of a wheel carriage pivot pin 27. Also pivotally attached to the housing is an adjustment cam, generally 18. Extending from one side of the housing, and attached thereto by anchor tabs 17 is a housing spring metal strip 16 in which is located a notch-shaped bend 21, while a housing slot 14 is located in the other end of the housing. The wheel carriage 26 has a grooved track wheel 32 pivotally attached thereto by means of track wheel axle pin 33. A wheel carriage spring 28 is held in position by wheel carriage pivot pin 27, having one fixed end attached to the wheel carriage by means of a wheel carriage spring anchor lug 29, and a free end extending in the opposite direction. The free end of spring 28 bears against a bent underportion 39 of one side of the housing 12, while the fixed end of the spring bears against wheel carriage 26 through lug 29, the action of the spring thereby urging the wheel carriage away from the housing 12. The amount of wheel carriage pivot thereby induced is limited by eventual contact of carriage pivot offset 31 against the bent underportion 39 of the housing side. Adjusting cam 18 pivots about cam axle trunion 40 which has an adjustment slot 20 located in the end thereof. Adjustment cam 18 is also furnished with friction pads 22, whose function will be described hereinafter, while a portion of the peripheral edge of the cam is provided with an adjustment knurl 24. The wheel carriage 26 has a counterpart knurl 30 located on the top thereof.

The wheel assembly 10 is insertable into a rib-slot 37 located in door molding 34. When so inserted, the top of the assembly housing 12 bears against the support flange 35, forming a part of the molding, the wheel assembly being kept in place by the engagement of one end of the rib-slot 37 of molding rib 36 with the housing slot 14, and by the engagement of the notch-shaped bend 21 of housing spring metal strip 16 with the other end of rib-slot 37. Door molding 34 is connected to the door screening 38, as better seen in FIG. 2.

In operation, wheel carriage spring 28 urges the wheel carriage 26 downwardly, causing grooved track wheel 32 to engage wheel track 41. The weight of the door 38, however, causes the wheel carriage 26 to pivot against such urging until the uppermost surface of the wheel carriage engages adjustment cam 18 which limits the pivoting of the wheel carriage, and therefore, determines the distance of the lower edge 44 of door molding 34 from the wheel track 41. The height of the door, which rests upon assembly housing 12 by virtue of the latter's contact with support flange 35 is, therefore, determined by the positioning of adjustment cam 18.

The dimensions of the component parts of the wheel assembly are not critical, but may be varied over a relatively wide range. Typically, however, the housing will be about 2 to 3 inches long, and from about 1 to 1 ½ inches high. Except for the small bent underportion of the housing 39, the housing is substantially U-shaped, and will typically be from about ¼ to ⅜ inch wide.

The wheel carriage 26 is likewise generally U-shaped, and will be approximately 1 ½ to 2 ½ inches long and about ¼ inch wide. The grooved track wheel commonly will have a diameter of about 1 inch and be about 3/16 inch wide and will have a radial groove of about ⅛ inch deep. The cam will be provided with a degree of eccentricity such that its range of adjustment will be about ½ to about ¾ inch.

Figure 2:
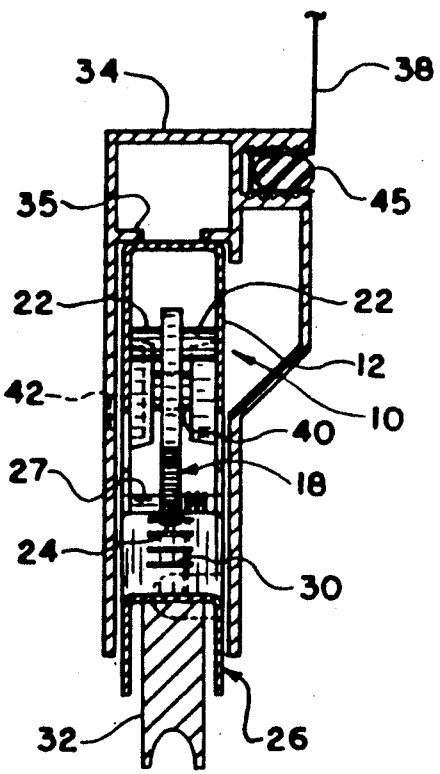
FIG. 2 is an end view of the roller assembly shown in FIG. 1, sectioned along line 2—2 of FIG. 1.

FIG. 2 is an end view of the roller assembly shown in FIG. 1, sectioned along line 2—2. As illustrated, the housing 12 is recessed in door molding 34, bearing against support flange 35. The molding 34 has a groove 45 located therein into which the screening 38 of the door is inserted, being held there, for example, by a gasket 45. Cam 18 is mounted within housing 12 by cam axle trunions 40 extending from each side of the cam. Friction pads 22 also extend from each side of the cam, bearing against the inner sides of housing 12, helping to maintain the cam in whatever position it has been rotated during adjustment. An adjustment slot access hole 42 is located in the door molding 34 to provide access to adjustment slot 20. The mating relationship of adjustment knurl 24 with wheel carriage knurl 30 is shown, the knurls serving the purpose of providing adjustment increments by which the distance of the assembly 10 from track 41 can be set. Wheel carriage 26 pivots about wheel carriage pivot pin 27, locating the position of grooved track wheel 32 attached to the end thereof. The friction pads 22 may be made from any resilient material having a coefficient of friction suitable for holding cam 18 in place once it has been adjusted. Typically, friction pads 22 will be made of an elastomeric material, such as rubber, although plastic, for instance, polyvinyl chloride, may also be so employed.

To position the wheel assembly 10 in the rib-slot 37, the wheel assembly is tilted to an angle suitable for engaging housing slot 14 in one end of the rib-slot 37. The other end of the housing is then rotated, bringing the housing spring metal strip 16 in contact with the opposite end of the rib-slot opening 37. The housing is subsequently forced into the opening, causing the spring metal strip 16 to bend until the notch-shaped bend 21 is adjacent to the rib-slot, at which point the spring metal strip forces the bend to firmly engage the edge of the rib-slot, locking the wheel assembly into position.

Figure 3:
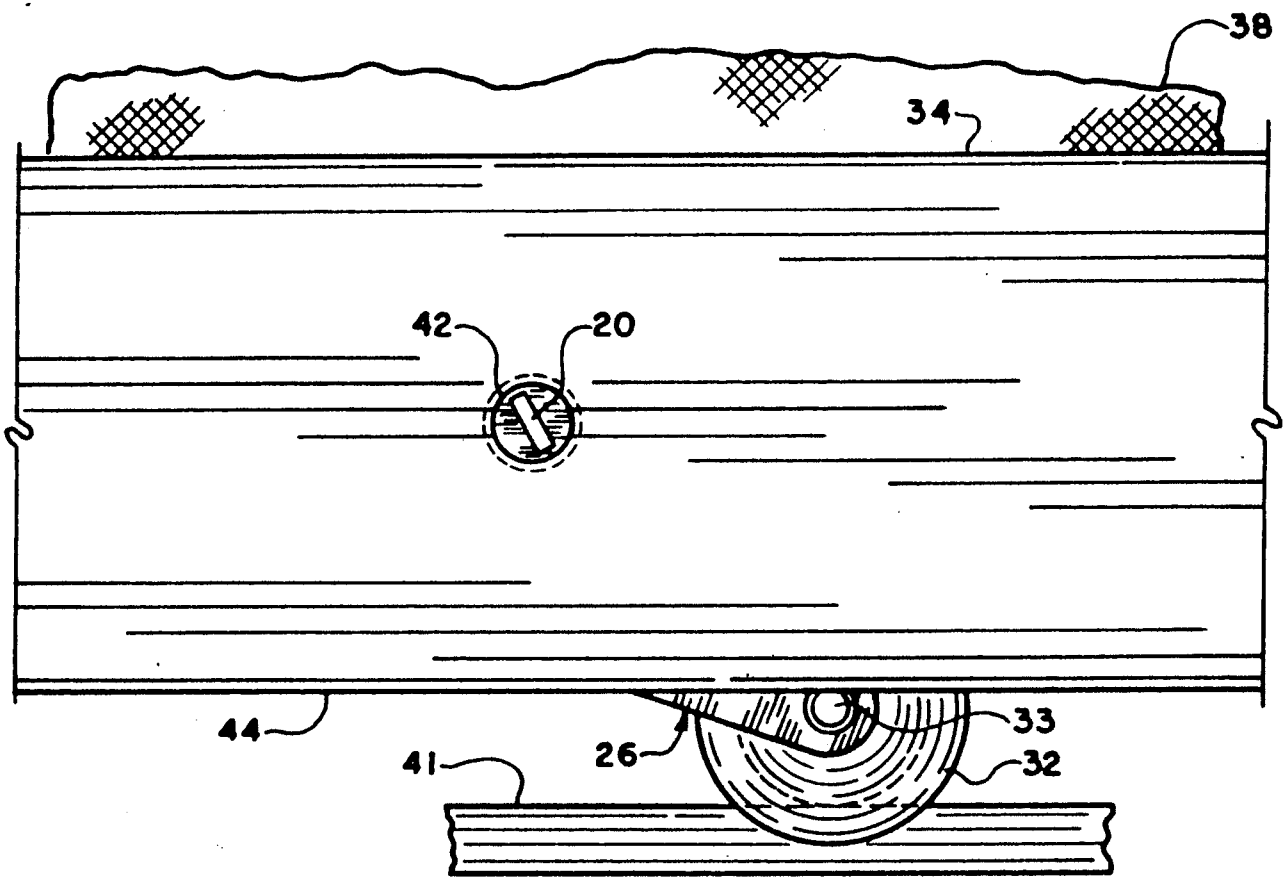
FIG. 3 is a front elevation of the roller assembly shown in FIG. 1 mounted in a door, illustrating the means of access to the adjustment feature thereof.

FIG. 3 is a front elevation of the roller assembly shown in FIG. 1 mounted in a door, illustrating the means of access to the adjustment feature thereof. The Figure shows a door molding 34 connected to a door, and a wheel carriage 26 with a grooved track wheel 32 engaged on a wheel track 41 extending from the lower edge of the door molding 44. The adjustment slot 20 of a cam axle trunion can be seen through an adjustment slot access hole 42, disposed in the wall of the door molding 34.

While the housing, wheel carriage, grooved track wheel and certain other components of the wheel assembly 10 can be made from any of a variety of metals, it is particularly desirable to use lightweight metals therefor, such as, for example, aluminum, to maintain the assembled door within acceptable weight parameters, and to avoid corrosion problems. Furthermore, while wheel assemblies of the type contemplated by the invention are particularly useful in connection with support rollers at the bottom of the doors, they may also be used at the top thereof, and more than one roller can be used in either or both locations. Also, while the invention has primarily been described in connection with doors, a use for which it is particularly adapted, it may also be used for any sliding panel supported on rollers that requires adjustment between the panel and the surface upon which it rests.

While in accordance with the patent statutes, a preferred embodiment and best mode has been presented, the scope of the invention is not limited thereto, but rather is measured by the scope of the attached claims.

What is claimed is:

1. A side-adjustable door roller assembly comprising:

a housing;

wheel carriage means, one end of which is pivotally attached to said housing at a pivot point, and the other end having a guide wheel rotatably attached thereto;

spring means urging said wheel to pivot away from said housing;

cam means located between said pivot point and said wheel and adjustable from the side of said housing for controlling the distance of said wheel from said housing when the wheel is urged toward said housing; and means for connecting said assembly to a door.

2. A side-adjustable door roller assembly comprising:

a housing with parallel, elongated sides;

wheel carriage means having a wheel rotatably attached to a first end thereof, and a second end attached to said sides at a pivot point, said wheel carriage means being pivotable about said point, parallel to said sides;

spring means urging said first end to pivot about said point, away from said housing;

cam means mounted in said housing between said pivot point and said wheel which limits the distance said first end can pivot towards said housing when said first end is urged to pivot against the urging of said spring means, said cam means being adjustable from at least one side of said housing to fix said distance, and means for connecting said housing to a door.

3. A door roller assembly according to claim 2 in which said cam means is a cam positioned between, and parallel to said sides which limits the distance said first end can pivot by contact of a surface of said cam with a surface of said carriage means.

4. A door roller assembly according to claim 3 in which said cam is provided with adjusting means on at least one side thereof designed for adjustment by an adjusting tool.

5. A door roller assembly according to claim 4 in which said cam is pivotal about trunions; said adjusting means is an opening in the end of at least one of said trunions, and said adjusting tool allows torque to be exerted on said trunion when inserted into said opening and rotated therein.

6. A door roller assembly according to claim 3 in which both said surfaces are knurled.

7. A door roller assembly according to claim 6 in which said cam has at least one friction pad extending therefrom that engages a surface of said housing.

8. A door roller assembly according to claim 2 in which said spring means is a tension spring wrapped about a pin at said pivot point, one end of said spring bearing against said carriage means, and the other end bearing against said housing.

9. A door roller assembly according to claim 2 in which said wheel has a groove in the radial edge thereof.

10. A door roller assembly according to claim 2 connected to the edge of a door providing access to adjust said cam means.

11. A door roller assembly according to claim 10 in which the door is a screen door; said edge is horizontal, and said door is provided with an opening for adjustment of said cam means.

12. A side-adjustable door roller assembly comprising: a housing with parallel, elongated sides;

wheel carriage means having a wheel rotatably attached to a first end thereof, and a second end attached to said sides at a pivot point, said wheel carriage means being pivotable about said point, parallel to said sides;

spring means urging said first end to pivot about said point, away from said housing;

cam means mounted in said housing which limits the distance of said first end can pivot toward said housing once said first end is urged to pivot against the urging of said spring means, said cam means being adjustable from at least one side of said housing to fix said distance, and means for connecting said housing to a door, in which said connecting means comprises a slot at one end of the sides of said housing, and a connecting strip of spring metal extending from the other end of said sides, one end of said connecting strip being attached to said housing, and the other end being unattached and having a notch-shaped bend therein, said slot and said notch being adapted to engage opposite ends, respectively, of an opening provided in the edge of a door designed to receive said door roller assembly.

13. A side-adjustable door roller assembly comprising:

a housing with parallel, spaced apart, elongated sides having a slot in a first end thereof;

a substantially U-shaped wheel carriage, a first end of which is pivotally attached to said housing at a pivot point, and a second end of which has a rotatable guide wheel attached thereto;

a spring bearing against said housing, and against said carriage, which urges the pivoting of said carriage away from said housing;

a strip of spring metal having one end attached to said housing, the other end extending from said housing and having a notch-shaped bend therein; and a cam adjustable from the side of said housing and mounted therein between said pivot point and said wheel which determines the distance between said housing and said carriage when forces acting on said door roller urge the carriage toward said housing against the urging of said spring, said cam having a friction pad extending from each side thereof adapted to engage the sides of said housing.

14. A door roller assembly according to claim 13 in which said cam is pivotally mounted in said housing by means of trunions which extend from each side of the pivot point of said cam, said trunions extending through the sides of said housing and having an adjustment slot in the end of at least one of which.

15. A door roller assembly according to claim 14 mounted within a door, said guide wheel extending from the edge thereof, and said door having an opening therein providing access to said adjustment slot.

* * * * *